US009295900B1

(12) United States Patent
Dixon, Jr.

(10) Patent No.: US 9,295,900 B1
(45) Date of Patent: Mar. 29, 2016

(54) ACCESS DOOR UNIT

(71) Applicant: Nicholas E. Dixon, Jr., Albertville, AL (US)

(72) Inventor: Nicholas E. Dixon, Jr., Albertville, AL (US)

( * ) Notice: Subject to any disclaimer, the term of this patent is extended or adjusted under 35 U.S.C. 154(b) by 0 days.

(21) Appl. No.: 14/121,714

(22) Filed: Oct. 10, 2014

Related U.S. Application Data

(63) Continuation-in-part of application No. 13/507,285, filed on Jun. 19, 2012, now Pat. No. 8,875,772.

(60) Provisional application No. 61/961,457, filed on Oct. 15, 2013.

(51) Int. Cl.

| | |
|---|---|
| ***A63B 71/02*** | (2006.01) |
| ***E06B 1/16*** | (2006.01) |
| ***E06B 3/80*** | (2006.01) |
| ***E06B 9/52*** | (2006.01) |
| ***E06B 1/52*** | (2006.01) |

(52) U.S. Cl.
CPC ..... *A63B 71/022* (2013.01); *E06B 1/16* (2013.01); *E06B 1/52* (2013.01); *E06B 3/80* (2013.01); *E06B 9/52* (2013.01)

(58) Field of Classification Search
CPC ..... A47G 5/00; A63B 71/022; E06B 1/16; E06B 9/52; E06B 3/80; E06B 1/52; E06B 7/32; E06B 2009/1527; A47H 23/04
USPC ..... 160/371, 135, 351, 180; 135/117; 473/421
See application file for complete search history.

(56) References Cited

U.S. PATENT DOCUMENTS

| | | | |
|---|---|---|---|
| 2,856,941 | A | 10/1958 | O'Neal |
| 2,919,798 | A | 1/1960 | Gottlieb |
| 3,513,862 | A | 5/1970 | Pohl et al. |
| 4,074,905 | A | 2/1978 | High |
| D276,466 | S | 11/1984 | Giovagnoli |
| 4,603,724 | A | 8/1986 | Borwick |
| 4,890,834 | A | 1/1990 | Ponza |
| 5,099,866 | A | 3/1992 | Solis et al. |
| 5,231,809 | A | 8/1993 | Benjamino et al. |
| 5,598,668 | A | 2/1997 | Isom |
| 5,660,002 | A | 8/1997 | Lashinger |
| 5,730,442 | A | 3/1998 | Anderson |
| 5,813,662 | A | 9/1998 | Langkruis |
| 5,878,802 | A | 3/1999 | Richter et al. |
| 6,151,852 | A | 11/2000 | Linn et al. |
| 6,354,968 | B1 | 3/2002 | Nozato |
| 6,684,584 | B1 | 2/2004 | Goldwitz |
| 6,939,255 | B2 | 9/2005 | Peterson |
| 6,981,540 | B2 | 1/2006 | Deblois |
| 2002/0098920 | A1 | 7/2002 | Bruyer et al. |
| 2004/0112550 | A1 | 6/2004 | Green |
| 2010/0018560 | A1 | 1/2010 | Millano et al. |

*Primary Examiner* — Blair M Johnson
(74) *Attorney, Agent, or Firm* — John R. Flanagan

(57) ABSTRACT

An access door unit includes a door, doorway structure, and elements for pivotally attaching the door to the doorway structure. The doorway structure has an outer perimeter frame and base affixed thereon. The base has support members extending in transverse relation to and outwardly fore and aft from the outer perimeter frame and adapted to rest on a generally level support surface such that the outer perimeter frame extends upright from the base enabling the doorway structure to assume a free-standing, self-supporting orientation on the support surface. The outer perimeter frame of the doorway structure defines a passage large enough to fit the door and permit entry or exit through the passage when the door is opened. A closure panel of the door may be full or half length in accordance with the different uses being made of the access door unit.

13 Claims, 10 Drawing Sheets

ACCESS DOOR UNIT

This patent application is a continuation-in-part of U.S. application Ser. No. 13/507,285 filed Jun. 19, 2012, which claims the benefit of U.S. Provisional Application No. 61/571,105 filed Jun. 21, 2011. The patent application also claims the benefit of U.S. Provisional Application No. 61/961,457 filed Oct. 15, 2013. Each application identified above is hereby incorporated by reference in its entirety to provide continuity of disclosure.

BACKGROUND OF THE INVENTION

1. Field of the Invention

The present invention generally relates to access to enclosures, such as batting cages, and, more particularly, is concerned with access door unit.

2. Description of the Prior Art

Enclosures, for example batting cages, typically do not come with or have a conventional or regular style door, one that opens, closes, latches, and allows users with baseball equipment to entry and exit easily to and from the batting cage. There are some batting cages that have what is called a "flap door", built into the net of the batting cage. The flap door typically is an overlapped piece of the net configured to form a flap that covers an opening in the netting. To enter or exit the batting cage the user has to fold back the flap and navigate through the opening usually while carrying baseball equipment. The flap door typically is cumbersome to manipulate and does not open wide enough for easy passage with equipment. Additionally, they are difficult to see and thus find in that they do not appear distinct from the net. Thus, they are neither easy nor convenient to use.

Many batting cages require users to lift a net wall of the batting cage to enter and exit. Lifting the cage wall can be difficult for many users in that a user has to stoup over or bend down. Furthermore, requiring that a wall be capable of being lifted for allowing entry or exit can also prevent the batting cage user from safely anchoring or "staking or weighting" the bottom edges of the batting cage walls to prevent passage of balls from the cage.

U.S. Patent No. Des. 276,466 to Giovagnoli discloses a batting cage with access doors to its batting compartments. The batting cage appears to be constructed by an extended framework supporting a net so as to define a plurality of side-by-side batting compartments. The extended framework appears to incorporate and support a doorway frame portion in a front wall of each batting compartment that extends from a corner thereof. The access doors to the batting compartments appear to be pivotally supported by the doorway frame portions. The approach of this design patent would appear to be dependent on and limited to the batting cages having the particular arrangement of the extended framework.

SUMMARY OF THE INVENTION

The present invention provides an access door unit designed to overcome the above-described drawbacks and satisfy the need for versatile, convenient and easy access to inside an enclosure, such as a batting cage. Specifically, the access door unit provides a doorway structure and a door which can be easily assembled and installed to provide the access door unit in a self-supporting relationship to the batting cage at any one of various different locations about the perimeter of the batting cage. The doorway structure has its own base support members which allow the unit to be self-standing, or free-standing, and thus installable in the self-supporting relationship at any of the different locations. Also, in one exemplary embodiment the door utilizes a double layer sock net which is easy to assemble on a peripheral door frame to form a closure panel of the door.

Accordingly, the present invention is directed to an access door unit which includes a door and a doorway structure. The door has a periphery and includes a peripheral frame defining the periphery and an interior open area of the door, and a closure panel attachable to the peripheral frame so as to extend across the interior open area of the peripheral frame.

The doorway structure has an outer perimeter frame and a support base. The outer perimeter frame includes right and left upright side portions and top and bottom portions extending between and interconnecting the right and left upright side portions so to define a passage through the outer perimeter frame being surrounded in continuous fashion by the outer perimeter frame and enough larger than the periphery of the door so that that door can fit within the passage of the doorway structure.

The support base is affixed on the outer perimeter frame. The support base includes right and left support members spaced apart from one another and extending in transverse relation to and outwardly in opposite fore and aft directions from the bottom portion of the outer perimeter frame such that the right and left support members are adapted to rest on a generally level support surface with the outer perimeter frame extending upright from the support base enabling the doorway structure, due solely to the right and left support members of the support base resting on the support surface, and solely to the outer perimeter frame extending upright from the support base, to assume a free-standing, self-supporting orientation on the support surface without any additional support from any other structure.

The access door unit also includes a plurality of elements for enabling the door to be pivotally moved toward and away from the passage of the outer perimeter frame of the doorway structure to permit entry or exit through the passage of the doorway structure.

In one embodiment, the closure panel of the door extends the full length of the interior open area of the peripheral frame of the door. In another embodiment, the closure panel of the door is a protective screen that extends approximately half of the length of the interior open area of the door and is pivotally convertible between up and down positions relative to the door and doorway structure in accordance with corresponding use for protecting softball and baseball pitchers. In further embodiment, the door is a protective screen that extends approximately half of the length of the passage of the doorway structure and is movably convertible between up and down positions relative to the doorway structure in accordance with corresponding use for protecting softball and baseball pitchers.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
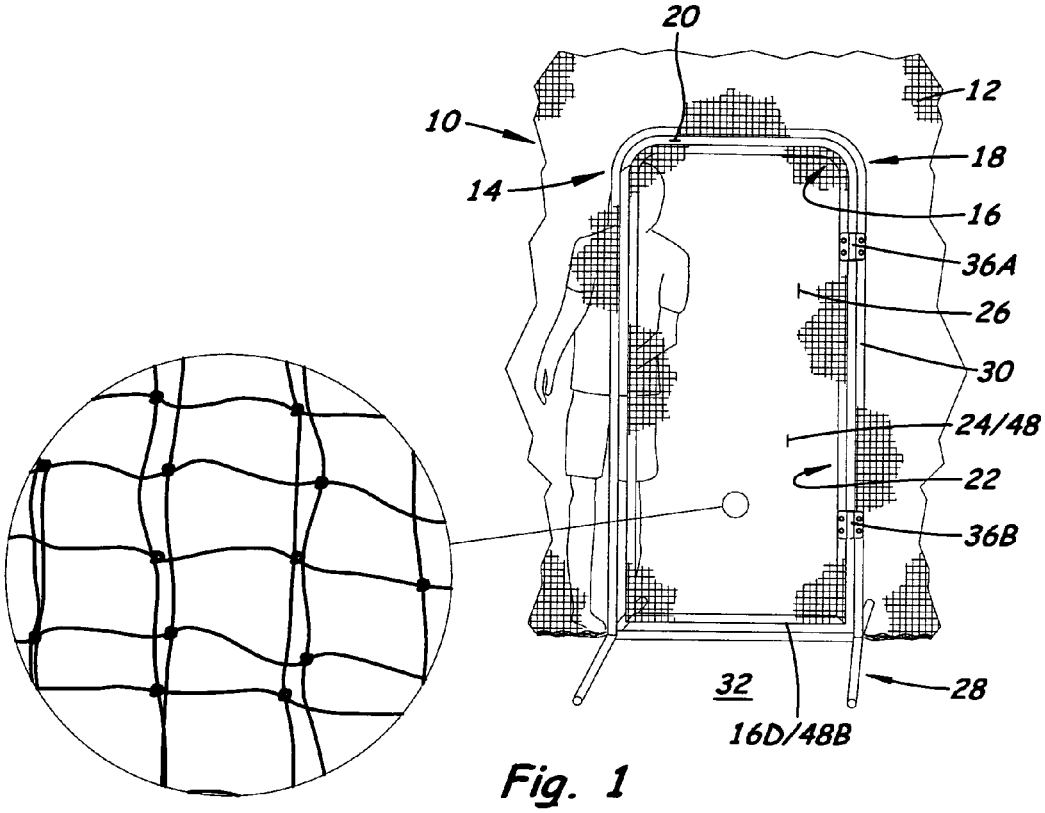
FIG. 1 is an elevational view of an exemplary embodiment of an access door unit installed in a batting cage in accordance with the present invention, showing a user initiating the opening of a door of the unit, the view also containing an enlarged fragmentary view to show the strands of a double layer sock net forming a closure panel of the door.
Figure 2:
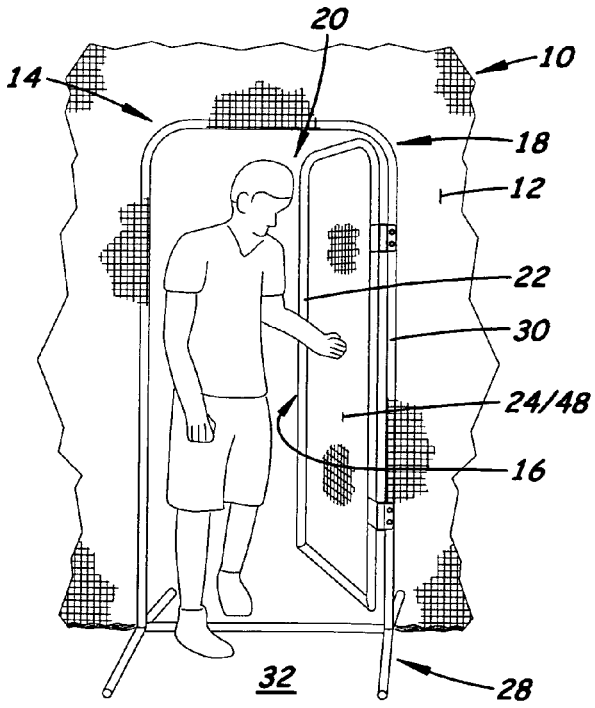
FIG. 2 is an elevational view similar to that of FIG. 1, now showing the user entering the batting cage through an access opening defined through a doorway structure of the unit after the door of the unit has been opened.

Referring to the drawings, and particularly to FIGS. 1 and 2, there is illustrated a wall of a conventional batting cage 10 formed by a vertically suspended or hanging net 12 unattached or free at its lower edge. (In various of the figures portions of the net 12 have been omitted for purposes of clarity and convenience in illustration.) The net 12 may be fabricated from strands of any suitable, preferably flexible, material, such as fabric, plastic or metallic woven cord or wire. Also shown is an exemplary embodiment of an access door unit 14, which constitutes one aspect of the present invention, installed or built into the net 12 of the batting cage 10. The access door unit 14 permits easy and convenient entry into and exit from the batting cage 10, as shown in FIGS. 1 and 2. While the access door unit 14 is disclosed herein installed into the wall or net 12 of the batting cage 10, it should be understood that the unit 14 also may be installed in a wall of a tent or various other types of enclosures.

As seen in FIGS. 1 and 2, the access door unit 14 basically includes a door 16, and a stationary self-standing doorway structure 18 surrounding the door 16 (when the door 16 is closed) and pivotally supporting the door 16 by an outer perimeter frame 30 of the doorway structure 18 which also defines a passage 20 through the doorway structure 18. The door 16 basically includes a peripheral frame 22 of generally rectangular configuration defining a periphery of the door 16. The door 16 also includes a closure panel 24 attached to and extending across an interior open area 26 defined by the peripheral frame 22. The doorway structure 18 basically includes a base 28 and the outer perimeter frame 30 of generally rectangular configuration attached on and extending upright from the base 28. The outer perimeter frame 30 of the doorway structure 18 is enough larger in circumference than the peripheral frame 22 of the door 16 that the latter can fit within the passage 20 of the former. To enter or exit the batting cage 10 a user unlatches the door 16, pivots the door 16 from a closed position to an opened position located away from the doorway structure 18, and then walks through its passage 20. The door 16 may then be returned to its closed position, either automatically or manually, and latched to the doorway structure 18 when it reaches the closed position.

Figure 3:
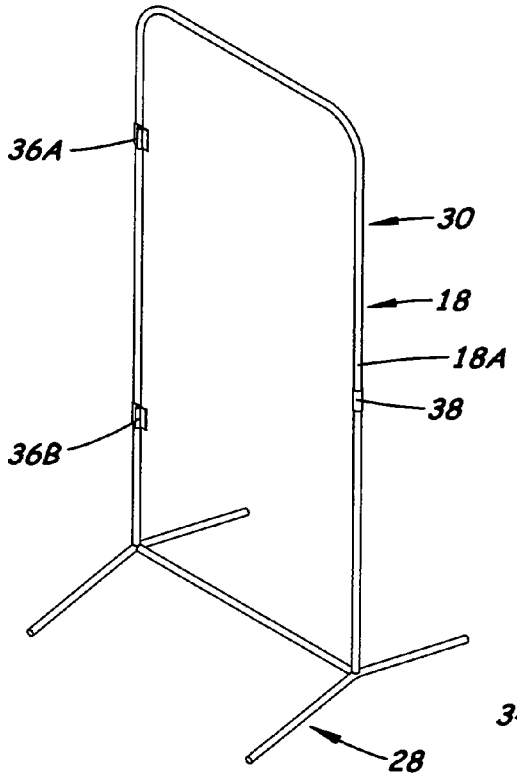
FIG. 3 is a perspective assembled view of an exemplary embodiment of the doorway structure of the access door unit which provides the unit with a self-standing, or free-standing, capability enabling it to be self-supporting relative to the batting cage.
Figure 4:
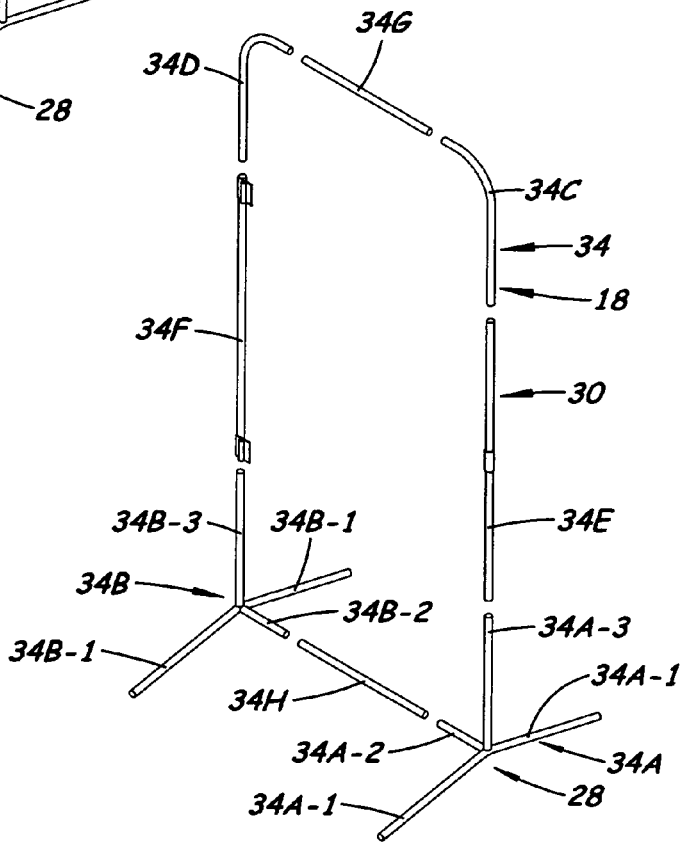
FIG. 4 is a perspective disassembled view of doorway structure of FIG. 4.

More clearly, FIGS. 3 and 4 show an exemplary embodiment of the doorway structure 18 that provides the access door unit 14 with a self-standing, self-supporting capability. This capability frees the access door unit 14 of the need for additional support from any structural frame component of the batting cage 10. It also allows the unit 14 to be quickly and easily installed in association only with the net 12 of the batting cage 10. With the access door unit 10 so installed self-standing on a substantially level flat surface 32, which also supports the batting cage 10, the net 12 of the batting cage 10 need not be disturbed. Instead, since entry and exit by users will now be through the passage 20 of the doorway structure 18 by use of the door 16, the bottom of the net 12 may be permanently staked or anchored to the support surface 32 in order to prevent balls from escaping the confinement of the batting cage 10. Furthermore, the access door unit 14 may be installed either in a new or (retrofitted in) an existing batting cage used either indoors or outdoors.

FIGS. 3 and 4 show the doorway structure 18 of the access door unit 14 by itself. (It should be noted here that the orientation of the doorway structure 18 shown in FIG. 3 is the reverse of that shown in FIGS. 1 and 2. It should be further noted that parts of the doorway structure 18 hereinafter identified as "right" and "left" are labeled in reference to their orientation in the doorway structure 18 as shown in FIGS. 3 and 5-11, and not as shown in FIGS. 1 and 2.) The doorway structure 18 may be assembled from a plurality 34 of parts, for example, four pairs of parts or eight parts in total, into the base 28 and an outer perimeter frame 30. The plurality 34 of parts may be constructed from widely-available metal tubing, for example steel or aluminum, by using well-known fabrication techniques. The plurality 34 of parts may be marketed disassembled in a package and then fitted and assembled, at the site of the batting cage 10, to one another, for example, at mateable male and female ends. The assembled parts are then secured together by use of fasteners, such as bolts and nuts (which are included in the disassembled parts package), applied to the mated ends in preparation for installing the doorway structure 18 into the net 12 of the hitting cage 10. In an exemplary embodiment, the doorway structure parts of each pair may be substantially identical to one another but different from the doorway structure parts of the other pairs.

In the exemplary embodiment shown in FIG. 4, the plurality 34 of parts for assembling the doorway structure 18 may include:

(1) lower right and left leg parts 34A, 34B arranged in a mirror image relationship to one another, both having respective fore-and-aft extending legs 34A-1, 34B-1, horizontal posts 34A-2, 34B-2 and vertical posts 34A-3, 34B-3 such that the horizontal and vertical posts are rigidly affixed on each of the respective legs at approximately midway between the opposite ends of the legs;

(2) upper right and left corner parts 34C, 34D also arranged in a mirror image relationship to one another and each having a substantially right angle configuration;

(3) right and left side parts 34E, 34F of substantially straight configurations and disposed between and interconnecting corresponding upper right and left corner parts 34C, 34D with the respective vertical posts 34A-3, 34B-3 of the lower right and left leg parts 34A, 34B; and (4) top and bottom parts 34G, 34H of substantially straight configurations, the top part 34G disposed between and interconnecting the upper right and left corner parts 34C, 34D with one another, the bottom part 34H disposed between and interconnecting the respective horizontal posts 34A-2, 34B-2 of the lower right and left leg parts 34A, 34B with one another.

Figure 17:
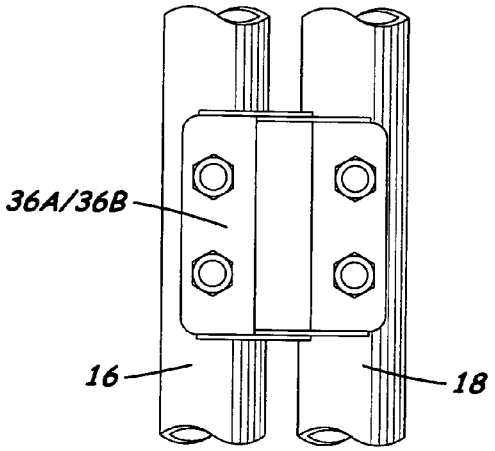
FIG. 17 is an elevational view of one exemplary embodiment of a hinge used to pivotally attach the door to the doorway structure of the access door unit.
Figure 18:
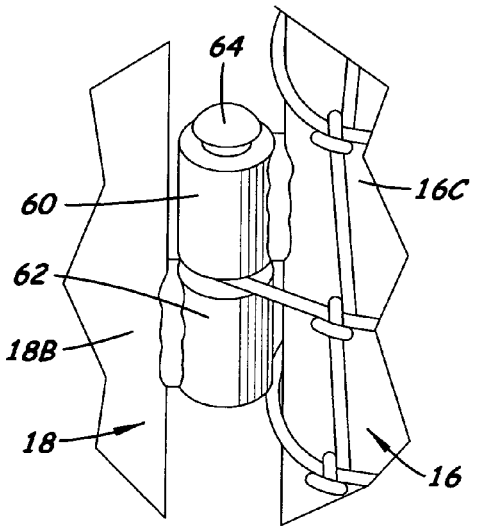
FIG. 18 is an elevational view of another exemplary embodiment of a hinge used to pivotally attach the door to the doorway structure of the access door unit.

The fore-and-aft extending leg 34A-1, 34B-1 and horizontal posts 34A-2, 34B-2 of the lower right and left leg parts 34A, 34B in conjunction with the bottom part 34H, which interconnects the horizontal posts 34A-2, 34B-2, constitute the base 28 of the doorway structure 18. The upper right and left corner parts 34C, 34D, the vertical and horizontal posts 34A-3, 34B-3 and 34A-2, 34B-2 of the lower right and left leg parts 34A, 34B and the bottom part 34H, which interconnects the horizontal posts 34A-2, 34B-2, constitute the outer perimeter frame 30 of the doorway structure 18. In addition, upper and lower hinges 36A, 36B are included in the disassembled parts package already attached to the upper left corner part 34D and left side part 34F of the doorway structure 18. The hinges 36A, 36B per se may be widely-available self-closing spring door types. The hinges 36A, 36B as shown in FIGS. 3 and 17 and hinges 60, 62, as shown in FIG. 18, are examples of suitable hinges that can be used. A door latch receiver 38 is also included in the disassembled parts package already attached to the right side part 34E approximately midway along the right vertical side 18A of the doorway structure 18.

Figure 5:
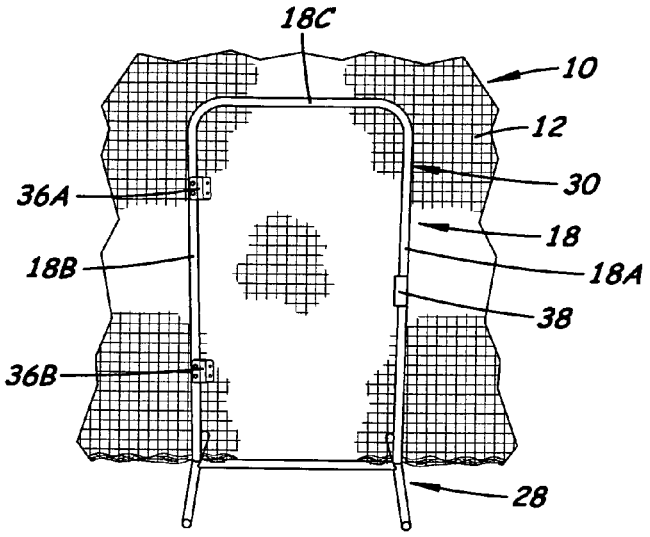
FIGS. 5-11 are a succession of views illustrating an exemplary embodiment of a sequence of steps in a method of installing the assembled doorway structure 18 of FIG. 3 in the net 12 of the batting cage 10.
Figure 6:
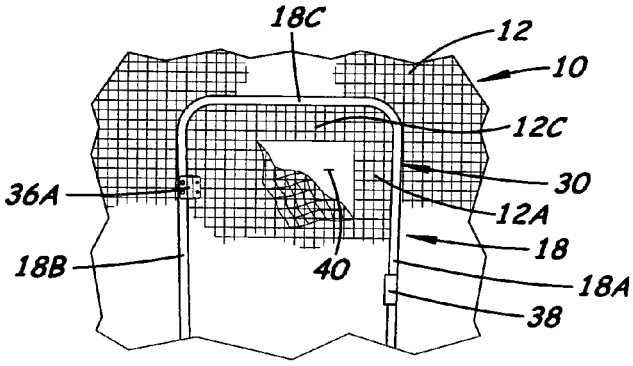
Figure 7:
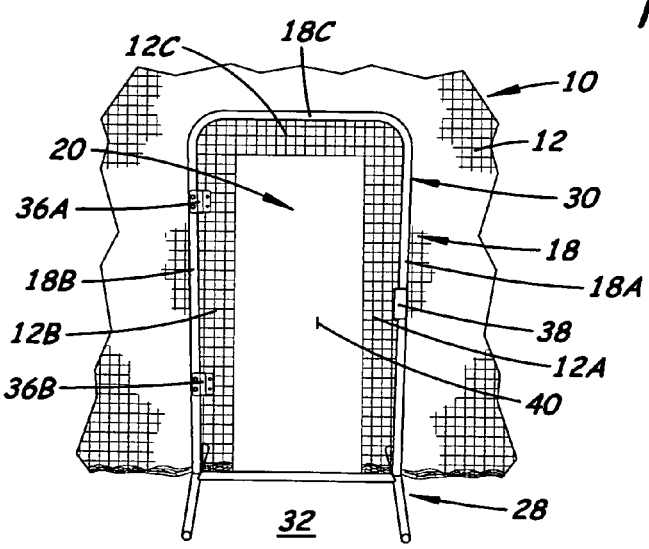
Figure 8:
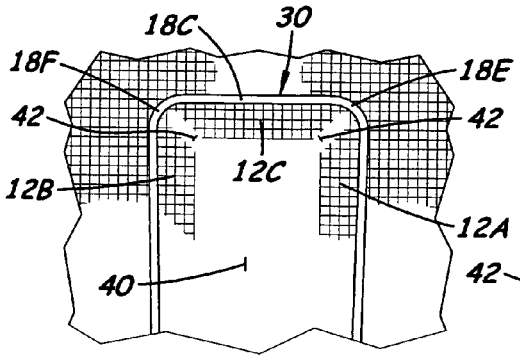
Figure 9:
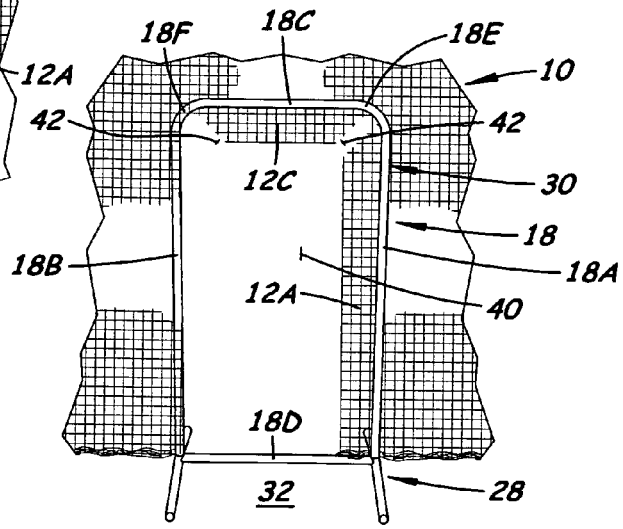
Figure 10:
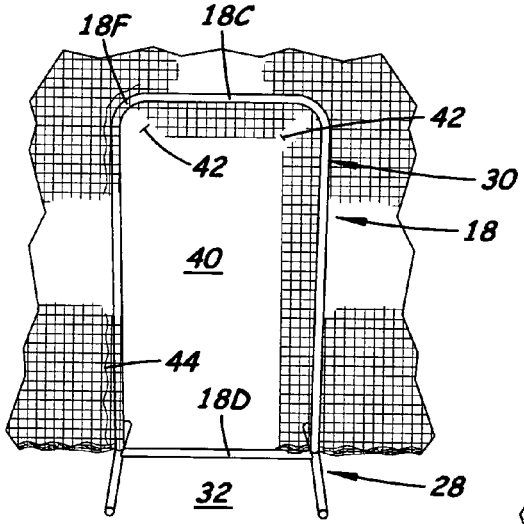
Figure 11:
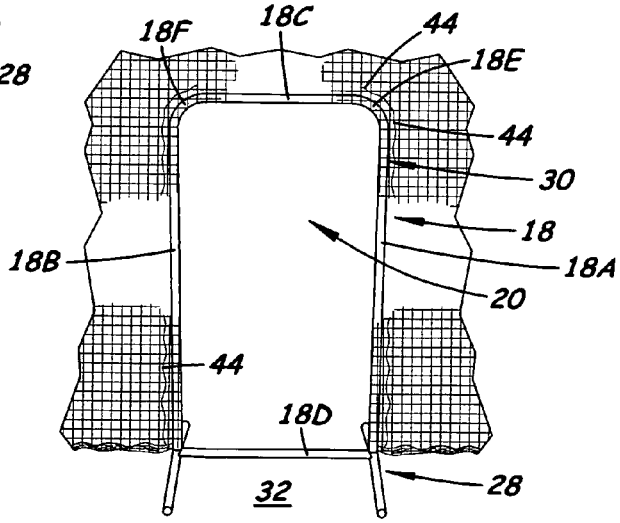

FIGS. 5-11 show an exemplary embodiment of a sequence of steps in a method of installing the assembled doorway structure 18 in the net 12 of the batting cage 10, which method constitutes another aspect of the present invention. FIG. 5 shows the doorway structure 18 placed adjacent the net 12 in the desired location where the access door unit 14 will be installed. FIGS. 6 and 7 show an initial sequence of steps taken to cut a generally centrally-located, vertically-elongated, rectangular-shaped hole 40 into a portion of the net 12 located within the outer perimeter frame 30 of the doorway structure 18. This is done in order to start to open the net 12 to provide the doorway passage 20 through it. FIGS. 7-9 show right, left and top marginal portions 12A-12C of the net 12 left untrimmed to allow their subsequent attachment respectively along the right vertical side 18A, left vertical side 18B and horizontal top 18C of the doorway structure 18. The horizontal bottom 18D of the doorway structure 18 which bounds the bottom of the passage 20 is, of course, left unattached to the net 12. FIG. 8 shows slits 42 cut in the net 12 at approximately diagonal angles that intersect upper right and left corners 18E, 18F of the outer perimeter frame 30. The slits 42 facilitate folding the right, left and top marginal portions 12A-12C of the net 12 over and about the right and left vertical sides 18A, 18B and horizontal top 18C of the doorway structure 18 and then attaching the marginal portions 12A-12C to portions of the net, in a final sequence of steps shown in FIGS. 9 and 10. The attaching step involves lacing or securing the marginal portions 12A-12C of the net 12 to the adjacent portions around the exterior of the outer perimeter frame 30 using strands 44 of flexible string, core or rope of appropriate lengths. FIG. 11 shows the completed installation of the doorway structure 18 in a freestanding orientation after the cage net 12 has been secured to the right and left vertical sides 18A, 18B and horizontal top 18C of the doorway structure 18.

Figure 12:
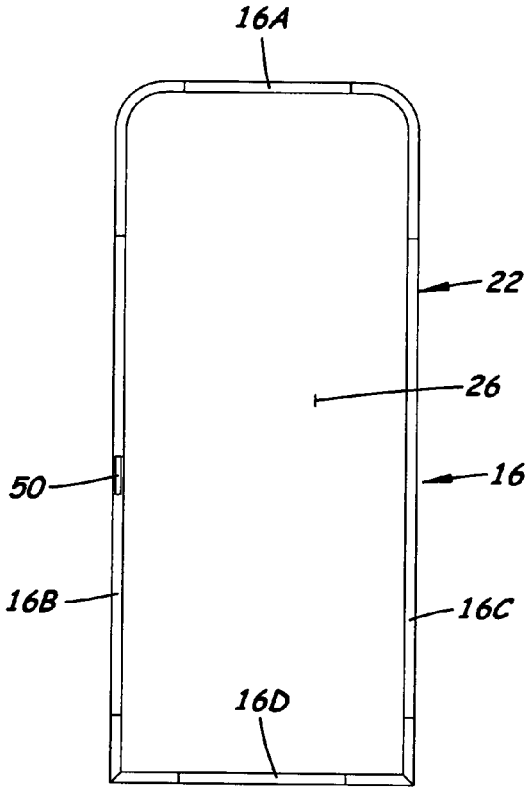
FIG. 12 is a perspective assembled view of an exemplary embodiment of a peripheral frame of the door of the access door unit.
Figure 13:
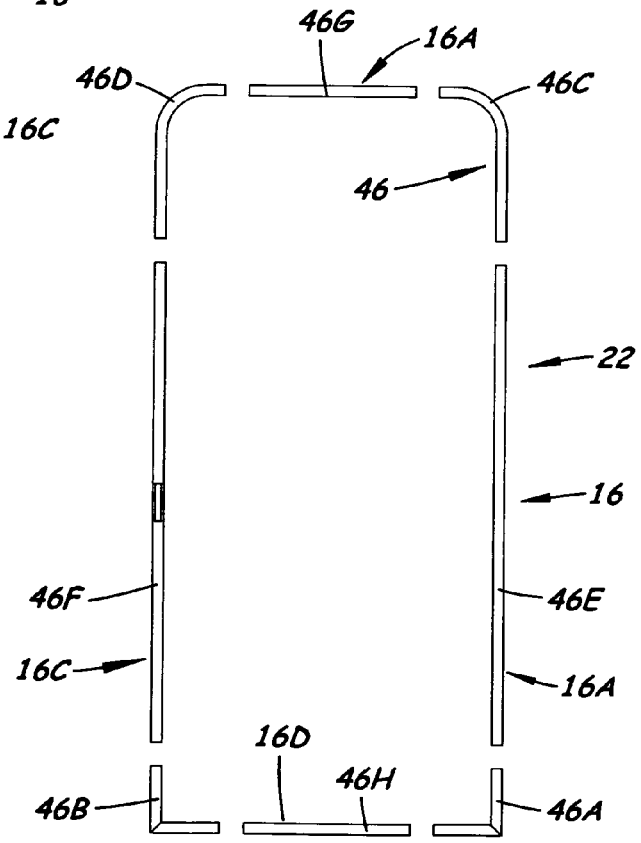
FIG. 13 is a perspective disassembled view of the peripheral frame of the door of the unit.

FIGS. 12 and 13 show the peripheral frame 22 of the door 16 of the access door unit 14 by itself. (It should be noted here that the orientation of the door 16 shown in FIGS. 12 and 14-16 is the same of that shown in FIGS. 1 and 2). The peripheral frame 22 of the door 16 may be assembled from a plurality 46 of parts, for example, four pairs of parts or eight parts in total, into the peripheral frame 22. The plurality 46 of parts may be constructed from widely-available metal tubing, for example steel or aluminum, by using well-known fabrication techniques. The plurality 46 of parts may be marketed disassembled in a package and then fitted and assembled to one another, for example, at mateable male and female ends. The assembled parts are then secured together by use of fasteners, such as bolts and nuts (which are included in the disassembled parts package), applied to the mated ends. The closure panel 24 of the door 16 attached to and extending across the interior open area 26 defined by the peripheral frame 22 may be constituted, for example, by a double layer of netting (see FIG. 1) formed into a sock net 48 (which also is included in the disassembled parts package). It is combined with the assembled parts of the peripheral frame 22 by sliding it over the assembled parts so that the sock net 48 extends across and covers the interior open area 26 bounded by the assembled parts of the peripheral frame 22, before mounting the door 16 to the doorway structure 18 via the upper and lower hinges 36A, 36B shown in FIG. 3. An alternative to the sock net 48 is a single layer of netting to form the closure panel 24 which could be employed by lacing the single layer of netting onto the peripheral frame 22 of the door 16. The use of the sock net 48, however, provides added convenience and is more durable in its ability of absorb impacts from balls. In an exemplary embodiment, the door parts of each pair may be substantially identical to one another but different from the door parts of the other pairs.

In the exemplary embodiment shown in FIG. 13, the plurality 46 of parts for assembling the peripheral frame 22 of the door 16 may include:

(1) lower right and left corners parts 46A, 46B arranged in a mirror image relationship to one another and each having a substantially right angle configuration;

(2) upper right and left corner parts 46C, 46D also arranged in a mirror image relationship to one another and each having a substantially right angle configuration;

(3) right and left side parts 46E, 46F of substantially straight configurations disposed between and interconnecting corresponding upper right and left corner parts 46C, 46D with lower right and left corner parts 46A, 46B; and (4) top and bottom parts 46G, 46H of substantially straight configurations and disposed between and interconnecting corresponding upper right and left corner parts 46C, 46D with one another and lower right and left corner parts 46A, 46B with one another.

In addition, a pivotal door latch 50 seen in FIG. 12 is included in the disassembled parts package already pivotally attached to the left side part 46F. The location of the door latch 50 is approximately midway along the midway along the left vertical side 16C of the door 16.

Figure 14:
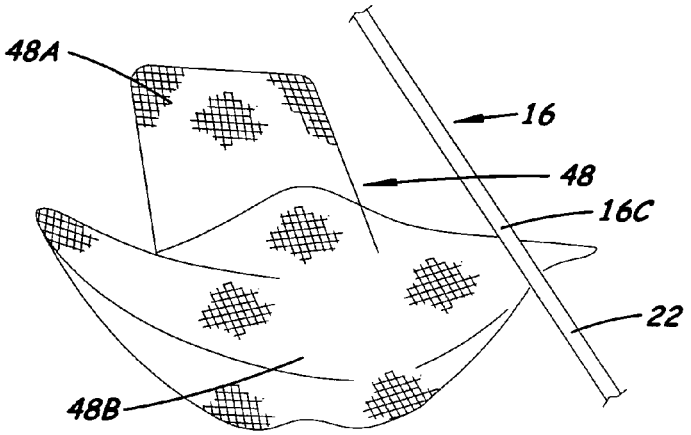
FIGS. 14-16 are a succession of views of an exemplary embodiment of a sequence of steps in a method of installing the sock net over the assembled peripheral frame of the door of FIG. 12.
Figure 15:
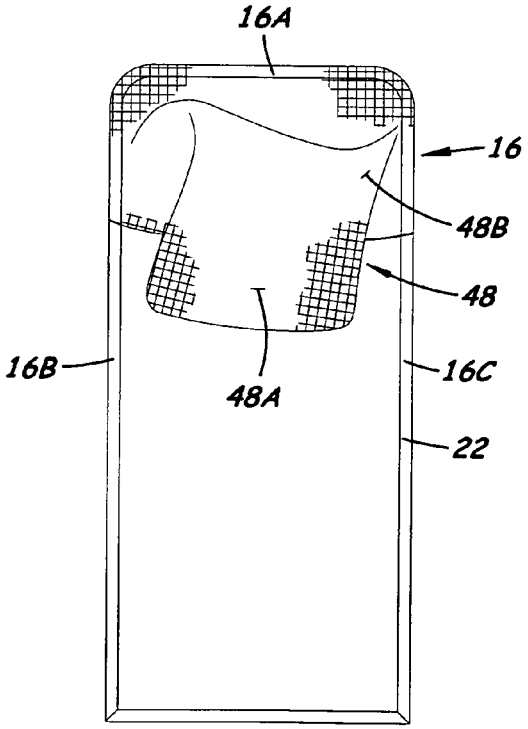
Figure 16:
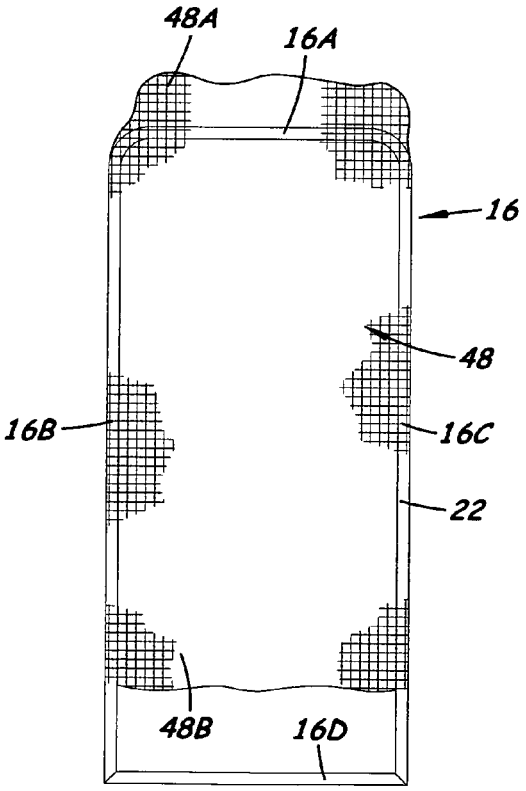

FIGS. 14-16 show an exemplary embodiment of a sequence of steps in a method of installing the sock net 48 over the assembled door 16, which method constitutes yet another aspect of the present invention. FIG. 14 shows the sock net 48 closed at what will become it top end 48A and opened at what will become its bottom end 48B after it is applied to the door 16 as shown in FIG. 1. FIGS. 15 and 16 show the sock net 48 at its open bottom end 48B placed over the horizontal top 16A of the door 16 and slid down the right and left vertical sides 16B, 16C of the door 16 until the sock net 48 fully covers the interior open area 26 (see FIG. 12) bounded by the door 16. FIG. 1 shows the door 16 installed in the doorway structure 18 after the sock net 48 has been applied and the bottom end 48B of the sock net 48 tied in place to the bottom 16D of the door 16.

As shown in FIG. 1, the door 16 is attached to the doorway structure 18 via the upper and lower hinges 36A, 36B, which are better seen FIGS. 3 and 17. Also, FIG. 17 shows close-up details of the hinge 36A, 36B pivotally attaching the door 16 to the doorway structure 18. FIGS. 12 and 3 respectively show one exemplary embodiment of components of a latch mechanism having the pivotal door latch 50 on the door 16 and the latch receiver 38 on the doorway structure 18. As the door 16 is moved to within the passage 20 of the doorway structure 18 the latch 50 rides up a ramp defined on the receiver 38 until it reaches an upwardly open notch. The latch 50 rotates and drops into the notch such that the door 16 is now latched in the closed position. By the user standing at the outside of the door 16 as shown in FIG. 1, after lifting the latch 50 from the notch the user can then pull on the door 16 to swing it open. A tab may be affixed to the door 16 so as to protrude from below the latch 50 and hold or supports the latch 50 in a horizontal position in which it will engage the ramp and ride up the ramp and fall into the notch merely by the closing movement of the door which is automatically caused by the self-closing hinges 36A, 36B. This capability ensures that the door 16 closes after each use. The user standing at the inside of the door 16 can reach a finger through the net 12 and engage and lift the latch 50 from receiver 38 in order to push open the door 16.

FIGS. 19-22 show another embodiment of components of a latch mechanism having double latches 54 and double receivers 56 which can be used on the door 16 and doorway structure 18. The double latches 54 are pivotally mounted at the front and rear (or outside and inside) of the right vertical side 16B of the door 16. The arms 58 may be separate from one another so as to be pivotally movable independently of one another or may be connected together so as to be pivotally movable in unison or together. In either case, they move toward and away from the double receivers 56 which are affixed at front and rear (or outside and inside) of the right vertical side 18A of the doorway structure 18.

FIG. 18 shows one hinge of a pair thereof of a different type (than that of FIG. 17), which can be used to pivotally mount the door 16 to the doorway structure 18, replacing the upper and lower hinges 36A, 36B seen in both FIGS. 3 and 17. Each hinge includes an upper tubular part 60 affixed to the door 16, a lower tubular part 62 affixed to the doorway structure 18, and a hinge pin 64 which inserts from above downward first through the upper tubular piece 60 and then through the lower tubular piece 62.

Figure 23:
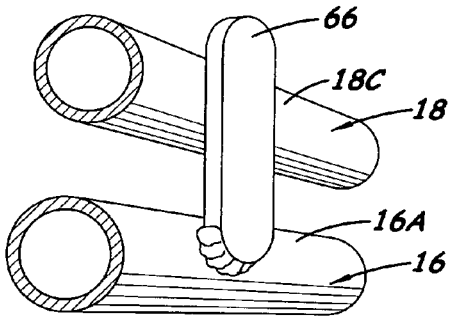
FIG. 23 is a perspective view of a top door stop affixed to a top portion of the door of the access door unit.
Figure 24:
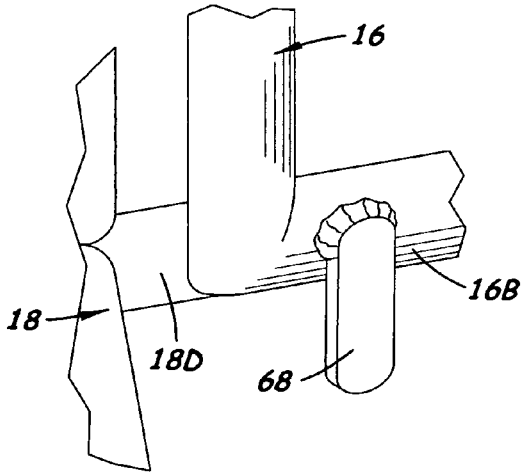
FIG. 24 is a perspective view of a bottom door stop affixed to a bottom portion of the door of the access door unit.
Figure 19:
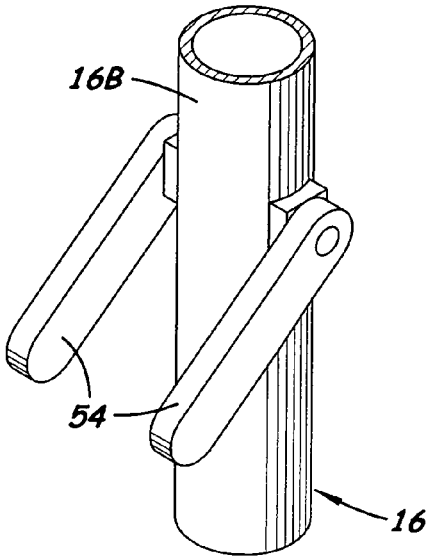
FIGS. 19-22 are respective perspective and elevational views of an exemplary embodiment of components of a latch mechanism used to latch the door to doorway structure of the access door unit.
Figure 20:
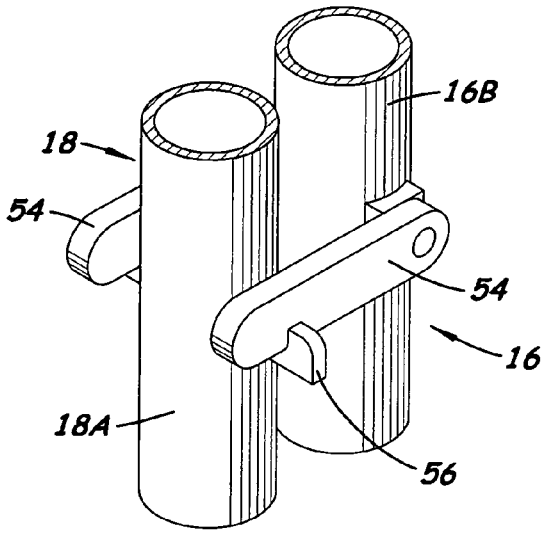
Figure 21:
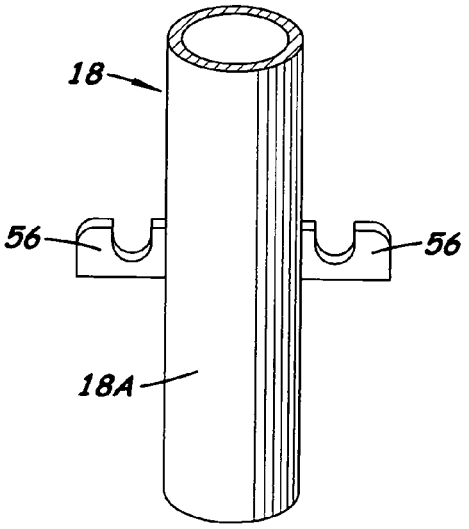
Figure 22:
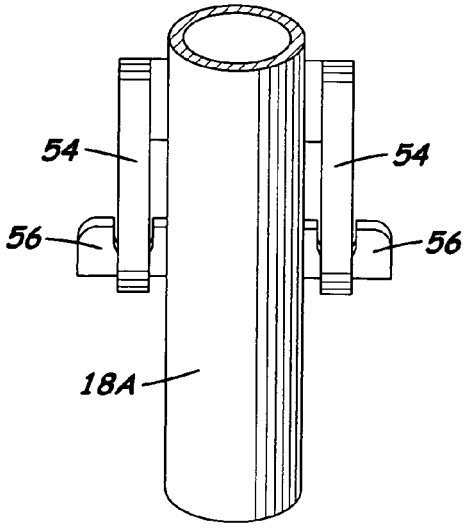

FIGS. 23 and 24 show top and bottom door stops 66, 68 affixed to the top 16A and bottom 16B of the door 16. The top and bottom door stops 66, 68 may take the form of straight parts which respectively extend upwardly from the top 16A and downwardly from the bottom 16D of the door 16 through sufficient distances to respectively engage the top 18C and bottom 18D of the doorway structure 18 so as to prevent the door 16 from swinging through the doorway structure 18 and instead restrict its pivotal movement toward and away from the doorway structure 18 to either at the front or rear of the doorway structure 18, depending upon whether the door stops 66, 68 are affixed to the front or rear of the door 16.

Figure 25:
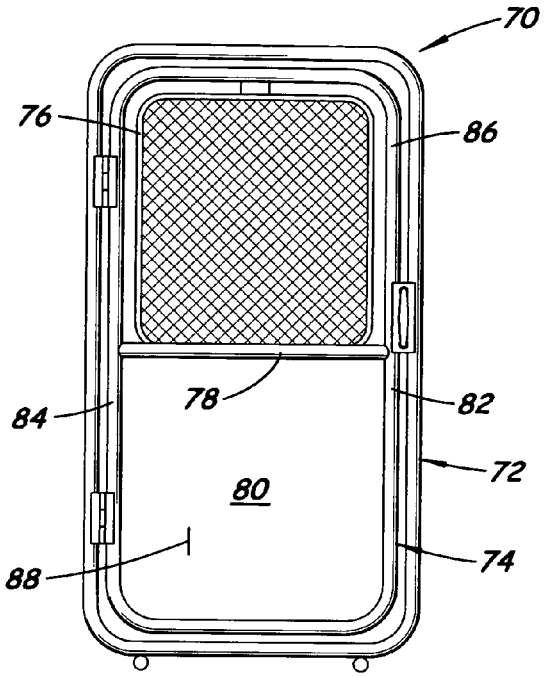
FIG. 25 is an elevational view of another exemplary embodiment of an access door unit adapted for use as a protective screen for a softball pitcher.
Figure 26:
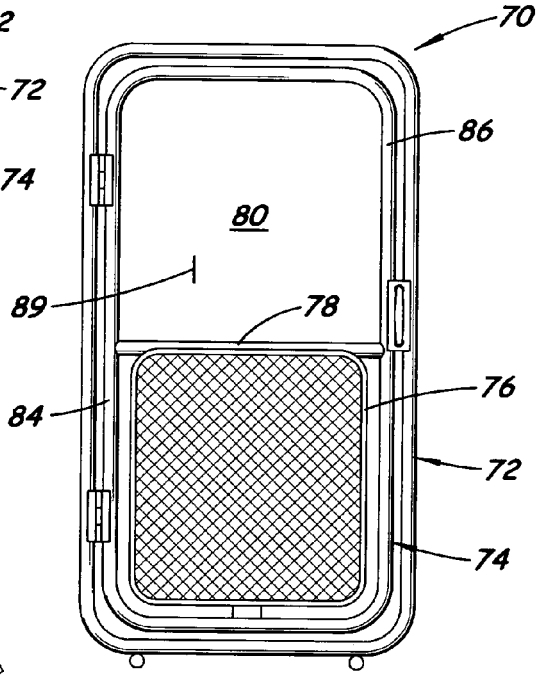
FIG. 26 is an elevational view of the access door unit of FIG. 25 now converted for use as a protective screen for a baseball pitcher.
Figure 27:
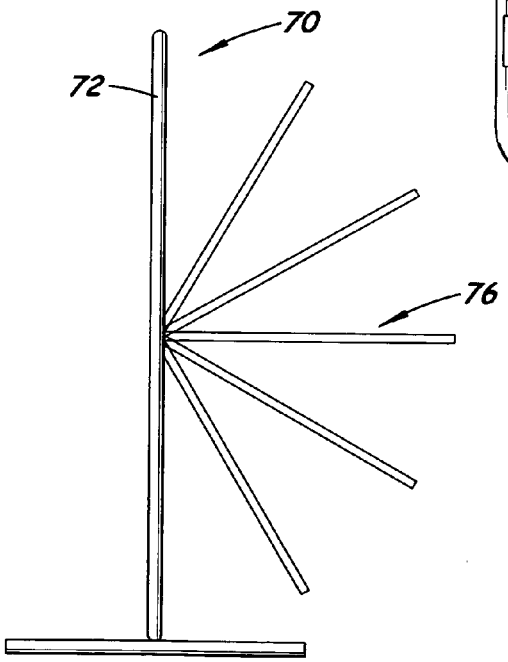
FIG. 27 is a side elevational view of the access door unit showing converting of its protective screen between an "up" position for softball and a "down" position for baseball.

Referring now to FIGS. 25-27, there is illustrated another exemplary embodiment of an access door unit, generally designated 70 adapted for free-standing use as a protective screen structure for a softball pitcher. FIGS. 25 and 26 show the door unit 70 having a doorway structure 72 and a door 74, as described hereinbefore with respect to door unit 14 except that the door 74 has a closure panel in the form of a protective screen 76 that extends about half the length of the interior open area 80 of the door 74 and thus of the passage of the doorway structure 72. The protective screen 76 is mounted to a transverse shaft 78 which extend across the interior open area 80 of the door 74 and is attached to right and left upright side portions 82, 84 of the outer peripheral frame 86 of the door 74 about midway between the top and bottom thereof. In such manner, the protective screen 76 is mounted to be pivotally converted, as shown in FIG. 27, between an upper position shown in FIG. 25 and a lower position shown in FIG. 26. In the upper or "up" position of FIG. 25 the protective screen is deployed for screening the upper portion of the interior open area 80 and thereby protecting a softball pitcher who will deliver the softball through the lower open portion 88 of the interior open area 80 of the door 74. In the lower or "down" position of FIG. 26 the protective screen is deployed for screening the lower portion of the interior open area 80 and thereby protecting a baseball pitcher who will deliver the baseball through the upper open portion 89 of the interior open area 80 of the door 74.

Figure 28:
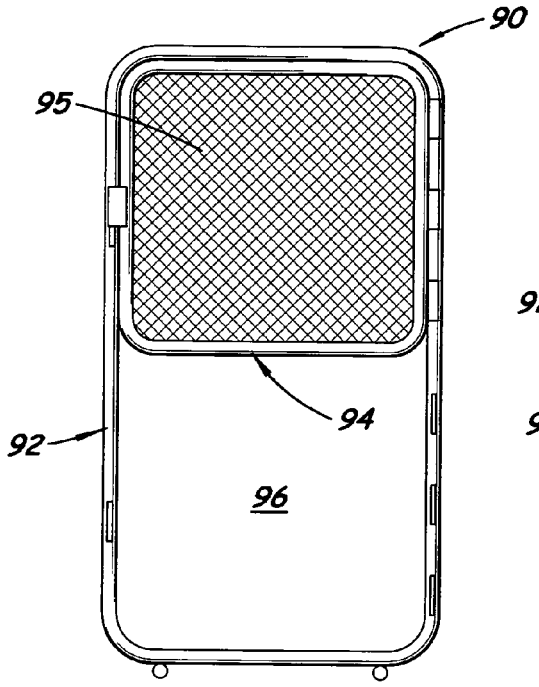
FIG. 28 is an elevational view of still another exemplary embodiment of an access door unit adapted for use as a protective screen for a softball pitcher.
Figure 29:
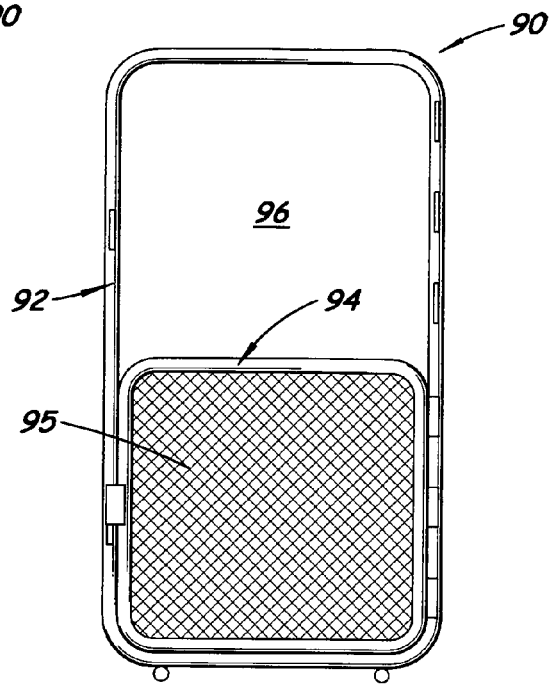
FIG. 29 is an elevational view of the access door unit of FIG. 28 now converted for use as a protective screen for a baseball pitcher.
Figure 30:
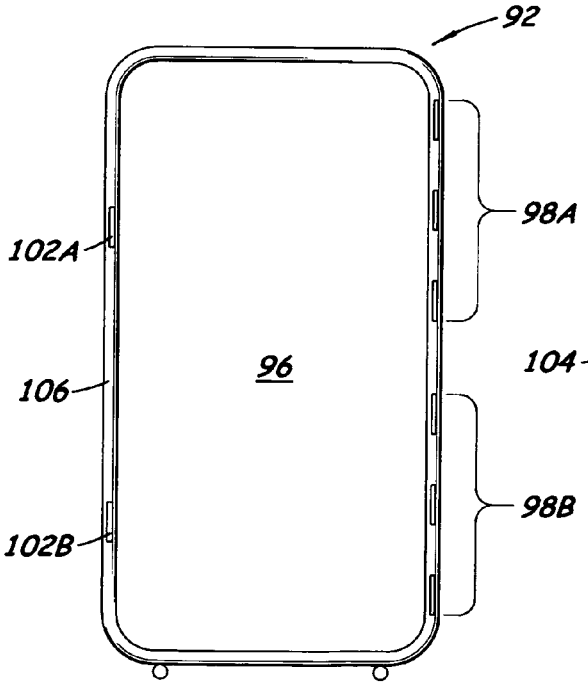
FIG. 30 is an elevational view of the doorway structure of the unit of FIGS. 28 and 29.
Figure 31:
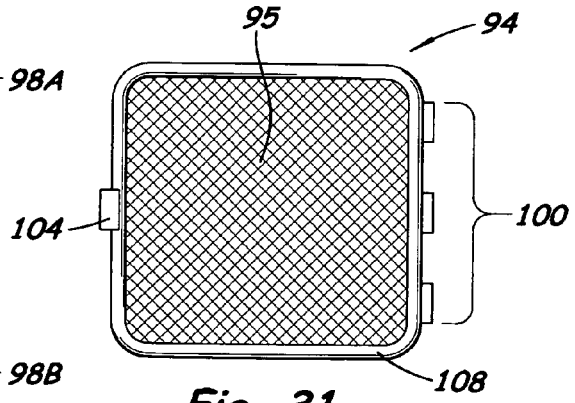
FIG. 31 is an elevational view of the screen panel of the unit of FIGS. 28 and 29.

Referring to FIGS. 28-31, there is illustrated still another exemplary embodiment of an access door unit, generally designated 90. FIGS. 28 and 29 show the door unit 90 having a doorway structure 92 and a door 94. The doorway structure 92 is as described hereinbefore with respect to door unit 14. The door 94 and its closure panel in the form of a protective screen 95 is now about half the length of the passage 96 of the doorway structure 92, instead of the full length as in the case of door units 14 and 70, so as to adapt the door 94 for use as a protective screen for a softball pitcher throwing the softball underhand when in the "up" position of FIG. 28 and for a baseball pitcher throwing the baseball overhand when in the "down" position of FIG. 29. FIGS. 30 and 31 respectively show the doorway structure 92 and door 94 of the door unit 90 of FIGS. 28 and 29 with the sets of spaced apart hinges 98A, 98B and 100 and latches 102A, 102B and 104 on the outer perimeter frame 106 of the doorway structure 92 and the peripheral frame 108 of the door 94. To convert the door 94 between the "up" position of FIG. 29 and the "down" position of FIG. 29, it may be lifted off one set of the hinges 98A, 98B on the doorway structure 92 and dropped onto the other set of hinges 98A, 98B on the doorway structure 92. On either set of hinges of the doorway structure 92, the door 94 is pivotally supported by the doorway structure 92 so as to be pivotally movable between a closed condition, wherein the door 94 is secured to the doorway structure 92 by either of latches 102A and 102B on the doorway structure 92 and the latch 104 on the door 94, and an opened condition, permitting entry or exit through the passage of the doorway structure 92.

To summarize, the above-described access door unit 14 is a self-supporting and self-standing door assembly that allows a buyer to quickly and easily install the unit in the net wall or end of the batting cage 10. The unit 14 may be advantageously marketed as a disassembled kit with conventional metal components or hardware to assemble the door 16 and doorway structure 18 and also with the netting for providing the sock net 48 to form the closure 24 of the door 16. The unit 14 gives the consumer the option to buy, assemble and install the unit into an existing batting cage 10. Thus, the unit 14 can be retrofitted to existing batting cages as well as installed with new batting cages. Also, the unit 14 can be used on indoor or outdoor batting cages. The unit 14 needs to be installed on a flat level indoor or outdoor surface so that the unit can stand alone without tilting or tipping over. Also, the access door units 70, 90 are self-supporting and self-standing and may be advantageously marketed as a disassembled kit in the same fashion as the access door unit 14.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. An access door unit in a batting cage, comprising:

a batting cage having a flexible wall of net with a hole made through said flexible wall of net, said hole being defined by right, left and top marginal portions of said flexible wall;

a door having a peripheral frame defining an interior open area of said door, said door also having a closure panel attachable to said peripheral frame so as to extend across said interior open area of said peripheral frame;

a doorway structure having an outer perimeter frame including right and left upright side portions and top and bottom portions extending between and interconnecting said right and left upright side portions so as to define a passage through said outer perimeter frame being surrounded in continuous fashion by said outer perimeter frame and enough larger than said peripheral frame of said door so that said door can fit within said passage of said doorway structure, and a support base affixed on at least said bottom portion of said outer perimeter frame, said support base including right and left support members spaced apart from one another and extending in transverse relation to and outwardly in opposite fore and aft directions from said bottom portion of said outer perimeter frame, wherein said bottom portion of said outer perimeter frame includes right and left horizontal bottom posts connected to corresponding ones of said right and left support members of said support base, connected to corresponding ones of right and left upright side portions of said outer perimeter frame, and extending toward one another and laterally from corresponding ones of said right and left support members of said support base and corresponding ones of said right and left upright side portions of said outer perimeter frame, and at least one horizontal bottom part extending between and interconnecting said right and left horizontal bottom posts such that said right and left support members of said bottom portion of said outer perimeter frame rest on a generally level support surface such that said outer perimeter frame extends upright from said support base enabling said doorway structure, due solely to said right and left support members of said support base resting on said support surface, and solely to said outer perimeter frame extending upright from said support base, to be in a free-standing, self-supporting orientation on the support surface without any additional support from any other structure other than from said wall of net, and wherein said doorway structure is installed in said hole made in said flexible wall of net of said batting cage with said right, left and top marginal portions of said flexible wall of net defining said hole being folded around said right and left upright side portions and said top portion of said outer perimeter frame of said doorway structure and secured to adjacent portions of said flexible wall of netting such that said passage of said outer perimeter frame also leads through said hole in said flexible wall of net of said batting cage; and a plurality of elements adapted to pivotally mount said peripheral frame of said door to one of said right and left upright side portions of said outer perimeter frame of said doorway structure to enable said door to be pivotally moved between opened and closed positions away from and toward said passage of said outer perimeter frame of said doorway structure.

2. The unit of claim 1 wherein said closure panel is made of flexible material.

3. The unit of claim 2 wherein said flexible material is at least a single layer of netting.

4. The unit of claim 2 wherein said flexible material is a double layer of netting.

5. The unit of claim 4 wherein said double layer of netting is formed as a sock insertable over said peripheral frame of said door.

6. The unit of claim 1 wherein said peripheral frame of said door is comprised of an assembly of tubes made of metal.

7. The unit of claim 1 wherein said outer perimeter frame of said doorway structure is comprised of an assembly of tubes made of metal.

8. The unit of claim 1 wherein:

said top portion of said outer peripheral frame includes a pair of upper right and left one-piece corner-forming parts and at least one horizontal top part extending between and interconnecting said upper right and left one-piece corner-forming parts; and said right and left upright side portions of said outer peripheral frame respectively include at least one right side part and at least one left side part extending between and interconnecting corresponding ones of said upper right and left one-piece corner-forming parts with corresponding ones of said right and left horizontal bottom posts.

9. The unit of claim 1 wherein said plurality of elements include at least two hinges spaced from each other along and attached to an upright portion of said peripheral frame of said door and said one of said right and left upright side portions of said outer perimeter frame of said doorway structure so as to pivotally support said door from said doorway structure.

10. The unit of claim 1 further comprising:

complementary latch parts on said peripheral frame of said door and said outer perimeter frame of said doorway structure permitting a user to unlatch said door, pivot said door away from the closed position toward the opened position located away from said doorway structure and then walk through said passage of said doorway structure in order to enter or exit the batting cage, pivot said door to the closed position and re-latch said door.

11. The unit of claim 1 wherein said closure panel of said door extends the full length of the interior open area of said peripheral frame of said door.

12. An access door unit for a batting cage having a wall of net, comprising:

a door having a peripheral frame defining an interior open area of said door, said door also having a closure panel attachable to said peripheral frame so as to extend across said interior open area of said peripheral frame;

a doorway structure having an outer perimeter frame including right and left upright side portions and top and bottom portions extending between and interconnecting said right and left upright side portions so as to define a passage through said outer perimeter frame being surrounded in continuous fashion by said outer perimeter frame and enough larger than said peripheral frame of said door so that said door can fit within said passage of said doorway structure, and a support base affixed on at least said bottom portion of said outer perimeter frame, said support base including right and left support members spaced apart from one another and extending in transverse relation to and outwardly in opposite fore and aft directions from said bottom portion of said outer perimeter frame, wherein said bottom portion of said outer perimeter frame includes right and left horizontal bottom posts connected to corresponding ones of said right and left support members of said support base, connected to corresponding ones of right and left upright side portions of said outer perimeter frame, and extending toward one another and laterally from corresponding ones of said right and left support members of said support base and corresponding ones of said right and left upright side portions of said outer perimeter frame, and at least one horizontal bottom part extending between and interconnecting said right and left horizontal bottom posts such that said bottom portion of said outer perimeter frame adapts said right and left support members to rest on a generally level support surface such that said outer perimeter frame extends upright from said support base enabling said doorway structure, due solely to said right and left support members of said support base resting on said support surface, and solely to said outer perimeter frame extending upright from said support base, to assume a free-standing, self-supporting orientation on the support surface without any additional support from any other structure other than the wall of net when attached thereto and further enabling said doorway structure to be installed in a hole made in the wall of net of the batting cage such that said passage of said outer perimeter frame also leads through the hole in the wall of net of the batting cage; and a plurality of elements adapted to pivotally mount said peripheral frame of said door to one of said right and left upright side portions of said outer perimeter frame of said doorway structure to enable said door to be pivotally moved between opened and closed positions away from and toward said passage of said outer perimeter frame of said doorway structure;

wherein said closure panel of said door is a protective screen that extends approximately half of the length of said interior open area of said door and is pivotally convertible between up and down positions relative to said door and doorway structure in accordance with corresponding use for protecting softball and baseball pitchers.

13. An access door unit for a batting cage having a wall of net, comprising:

a door having a peripheral frame defining an interior open area of said door, said door also having a closure panel attachable to said peripheral frame so as to extend across said interior open area of said peripheral frame;

a doorway structure having an outer perimeter frame including right and left upright side portions and top and bottom portions extending between and interconnecting said right and left upright side portions so as to define a passage through said outer perimeter frame being surrounded in continuous fashion by said outer perimeter frame and enough larger than said peripheral frame of said door so that said door can fit within said passage of said doorway structure, and a support base affixed on at least said bottom portion of said outer perimeter frame, said support base including right and left support members spaced apart from one another and extending in transverse relation to and outwardly in opposite fore and aft directions from said bottom portion of said outer perimeter frame, wherein said bottom portion of said outer perimeter frame includes right and left horizontal bottom posts connected to corresponding ones of said right and left support members of said support base, connected to corresponding ones of right and left upright side portions of said outer perimeter frame, and extending toward one another and laterally from corresponding ones of said right and left support members of said support base and corresponding ones of said right and left upright side portions of said outer perimeter frame, and at least one horizontal bottom part extending between and interconnecting said right and left horizontal bottom posts such that said bottom portion of said outer perimeter frame adapts said right and left support members to rest on a generally level support surface such that said outer perimeter frame extends upright from said support base enabling said doorway structure, due solely to said right and left support members of said support base resting on said support surface, and solely to said outer perimeter frame extending upright from said support base, to assume a free-standing, self-supporting orientation on the support surface without any additional support from any other structure other than the wall of net when attached thereto and further enabling said doorway structure to be installed in a hole made in the wall of net of the batting cage such that said passage of said outer perimeter frame also leads through the hole in the wall of net of the batting cage; and a plurality of elements adapted to pivotally mount said peripheral frame of said door to one of said right and left upright side portions of said outer perimeter frame of said doorway structure to enable said door to be pivotally moved between opened and closed positions away from and toward said passage of said outer perimeter frame of said doorway structure;

wherein said door is a protective screen that extends approximately half of the length of said passage of said doorway structure and is movably convertible between up and down positions relative to said doorway structure in accordance with corresponding use for protecting softball and baseball pitchers.

* * * * *